US008991104B2

(12) United States Patent
Warner et al.

(10) Patent No.: US 8,991,104 B2
(45) Date of Patent: Mar. 31, 2015

(54) METHOD AND APPARATUS FOR DISTRIBUTING A LOAD ABOUT AN AIR BEAM

(75) Inventors: Harold Warner, Calgary (CA); Stanislaw A. Lukasiewicz, Calgary (CA)

(73) Assignee: Dynamic Shelters Inc., Calgary, Alberta ( * ) Notice: Subject to any disclaimer, the term of this patent is extended or adjusted under 35 U.S.C. 154(b) by 558 days.

(21) Appl. No.: 12/555,254

(22) Filed: Sep. 8, 2009

(65) Prior Publication Data

US 2010/0139175 A1 Jun. 10, 2010

Related U.S. Application Data

(60) Provisional application No. 61/094,727, filed on Sep. 5, 2008.

(51) Int. Cl.

| | |
|---|---|
| ***E04G 11/04*** | (2006.01) |
| ***E04H 15/20*** | (2006.01) |
| ***E04C 3/00*** | (2006.01) |
| ***E04C 3/38*** | (2006.01) |

(52) U.S. Cl.

CPC . *E04C 3/005* (2013.01); *E04C 3/38* (2013.01); *E04H 2015/201* (2013.01)

USPC ..... 52/2.25; 52/2.11; 52/2.18; 52/2.21; 52/2.24

(58) Field of Classification Search

CPC ..... E04H 15/20; E04H 2015/201

USPC ..... 52/2.25, 2.11, 2.18, 2.21, 2.24, 562, 63; 403/5; 135/97, 156

See application file for complete search history.

(56) References Cited

U.S. PATENT DOCUMENTS

| | | | | |
|---|---|---|---|---|
| 3,159,165 | A | 12/1964 | Cohen et al. | |
| 3,353,309 | A | 11/1967 | Kwake | |
| 3,651,609 | A | 3/1972 | Bird | |
| 3,728,831 | A | 4/1973 | Bird | |
| 4,631,873 | A * | 12/1986 | Parish | 52/2.21 |
| 4,932,169 | A * | 6/1990 | Charbonneau | 52/2.18 |
| 5,343,658 | A | 9/1994 | McLorg | |
| 5,450,703 | A * | 9/1995 | Fuhrman et al. | 52/843 |
| 5,735,083 | A | 4/1998 | Brown et al. | |
| 5,987,822 | A * | 11/1999 | McNiff et al. | 52/2.11 |
| 6,182,398 | B1 | 2/2001 | Head | |

(Continued)

FOREIGN PATENT DOCUMENTS

| | | |
|---|---|---|
| EP | 494053 | 7/1992 |
| WO | WO 2005/079296 | 9/2005 |

OTHER PUBLICATIONS

"Hug". Dictionary.com. <http://dictionary.reference.com/browse/hug>.*

(Continued)

*Primary Examiner* — Mark Wendell

(74) *Attorney, Agent, or Firm* — Gowling Lafleur Henderson LLP; D. Doak Horne

(57) ABSTRACT

An apparatus for connecting an attachment and an air beam comprising a hug strap attached to a hug strap pad, the hug strap adapted to connect with the attachment, and the hug strap pad adapted to attach to the air beam. A method of securing an attachment to an air beam comprising providing an air beam, attaching a hug strap to a hug strap pad, securing the hug strap pad (with the hug strap attached) to the air beam, and securing the attachment to the hug strap.

23 Claims, 10 Drawing Sheets

(56) References Cited

U.S. PATENT DOCUMENTS

| | | | | |
|---|---|---|---|---|
| 6,282,843 | B1 * | 9/2001 | Shibaike et al. | 52/2.11 |
| 6,332,290 | B1 * | 12/2001 | Delamare | 52/2.22 |
| 6,463,699 | B1 | 10/2002 | Bailey et al. | |
| 6,543,730 | B2 | 4/2003 | Pedretti | |
| 6,584,732 | B2 | 7/2003 | Miller et al. | |
| 6,679,007 | B1 * | 1/2004 | Minchew et al. | 52/2.11 |
| 7,293,412 | B2 | 11/2007 | Fuchs | |
| 7,467,496 | B1 * | 12/2008 | Cuisset et al. | 52/2.18 |
| 7,836,636 | B2 * | 11/2010 | Luchsinger | 52/2.11 |
| 2007/0251185 | A1 | 11/2007 | Haggard et al. | |
| 2007/0271854 | A1 | 11/2007 | Wiegand et al. | |
| 2009/0188184 | A1 * | 7/2009 | McGary | 52/192 |
| 2010/0146868 | A1 * | 6/2010 | Lukasiewicz et al. | 52/2.11 |

OTHER PUBLICATIONS

"About". Dictionary.com. <http://dictionary.reference.com/browse/about>.*

Lukasiewicz et al., "Collapse Loads of a Cylindrical or Toroidal Free-Standing Inflatable Membrane", Mechanics of Structures and Machines, vol. 18, No. 4, pp. 499-513, 1990.

Lukasiewicz et al., "Collapse Mode of an Inflatable Free-Standing Membrane", Mechanics of Structures and Machines, vol. 18, No. 4, pp. 483-497, 1990.

* cited by examiner

METHOD AND APPARATUS FOR DISTRIBUTING A LOAD ABOUT AN AIR BEAM

CROSS REFERENCE TO RELATED APPLICATIONS

This application claims the benefit of priority of U.S. Provisional Patent Application No. 61/094,727 filed Sep. 5, 2008, which is incorporated herein by reference in its entirety.

FIELD OF THE INVENTION

The present invention relates generally to static structures. More particularly, the present invention relates to air beam construction static structures.

BACKGROUND OF THE INVENTION

Inflatable structural members, commonly referred to as "air beams" may be assembled to form large inflatable shelters. The pneumatic columns may be difficult to connect with other structural elements/attachments due to their relative weakness and susceptibility to puncture. This can make them difficult to incorporate into structures and attach to footings, anchors, guy wires, supports, etc.

It is, therefore, desirable to provide a method and apparatus for distributing the attachment point loading for air beam structures.

SUMMARY OF THE INVENTION

It is an object of the present invention to obviate or mitigate at least one disadvantage of previous methods and apparatus for distributing the attachment point loading for air beam structures.

In a first aspect, the present invention provides an apparatus for connecting an attachment and an air beam, the apparatus comprising an elongate hug strap for hugging a perimeter surface of the air beam, the elongate hug strap adapted to connect with the attachment, and a hug strap pad attached to the elongate hug strap, the hug strap pad for attaching to the perimeter surface.

In one embodiment, the elongate hug strap is attached to the hug strap pad by stitching.

In one embodiment, the hug strap pad comprises an elongate strap.

In one embodiment, the elongate hug strap is color coded to identify a design parameter. In one embodiment, the design parameter is selected from the group consisting of design strength, design usage, year of manufacture, sequence of assembly, and a combination thereof.

In one embodiment, the elongate hug strap extends between a first end and a second end, each of the first end and the second end having an end connector, the end connectors adapted to receive an end link member.

In one embodiment, the end connector includes a loop or a grommet.

In one embodiment, the elongate hug strap further includes an intermediate connector, between the first end and the second end, and the intermediate connector is adapted to receive an intermediate link member.

In one embodiment, the intermediate connector includes a loop or a grommet.

In one embodiment, the apparatus further includes a standoff extending between the elongate hug strap and the intermediate connector.

In one embodiment, the hug strap pad is attached to the elongate hug strap substantially continuously about the perimeter surface.

In one embodiment, the hug strap pad is wider than the elongate hug strap.

In a further aspect, the present invention provides an air beam including an elongate pneumatic tubular column having a perimeter surface. A hug strap pad is attached to the perimeter surface. An elongate hug strap is attached to the hug strap pad and hugs the perimeter surface. The elongate hug strap is adapted to connect with an attachment.

In one embodiment, the hug strap is attached to the hug strap pad by stitching.

In one embodiment, the hug strap pad is attached to the pneumatic tubular column by welding.

In one embodiment, the hug strap pad is attached to the elongate hug strap substantially continuously about the perimeter surface.

In one embodiment, the hug strap pad is attached to the perimeter surface substantially continuously about the perimeter surface.

In one embodiment, the hug strap pad is wider than the elongate hug strap.

In a further aspect, the present invention provides a method of securing an attachment to an air beam. The method includes providing an air beam having a perimeter surface, attaching an elongate hug strap to a hug strap pad, securing the hug strap pad, with the elongate hug strap attached, to the air beam, wherein the elongate hug strap hugs the perimeter surface, and securing the attachment to the elongate hug strap.

In one embodiment, the elongate hug strap and the hug strap pad are attached by stitching. In one embodiment, the hug strap pad and the air beam are attached by welding.

In one embodiment, the attachment is selected from the group consisting of a guy wire, a reinforcing member, a cable, or a combination thereof.

In a further aspect, the present invention provides an apparatus for connecting a first air beam and a second air beam. The apparatus includes a first elongate hug strap for hugging a first perimeter surface of the first air beam and a first hug strap pad attached to the first elongate hug strap, the first hug strap pad for attaching to the first perimeter surface. The apparatus also includes a second elongate hug strap for hugging a second perimeter surface of the second air beam and a second hug strap pad attached to the elongate second hug strap, the second hug strap pad for attaching to the second perimeter surface. The apparatus also includes biasing means for biasing the first elongate hug strap and the second elongate hug strap together. In one embodiment, the biasing means comprises a ratchet assembly.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides a method and system for providing an attachment connection for connecting with a pneumatic tubular columns (arches) such as air beams.

Figure 1:
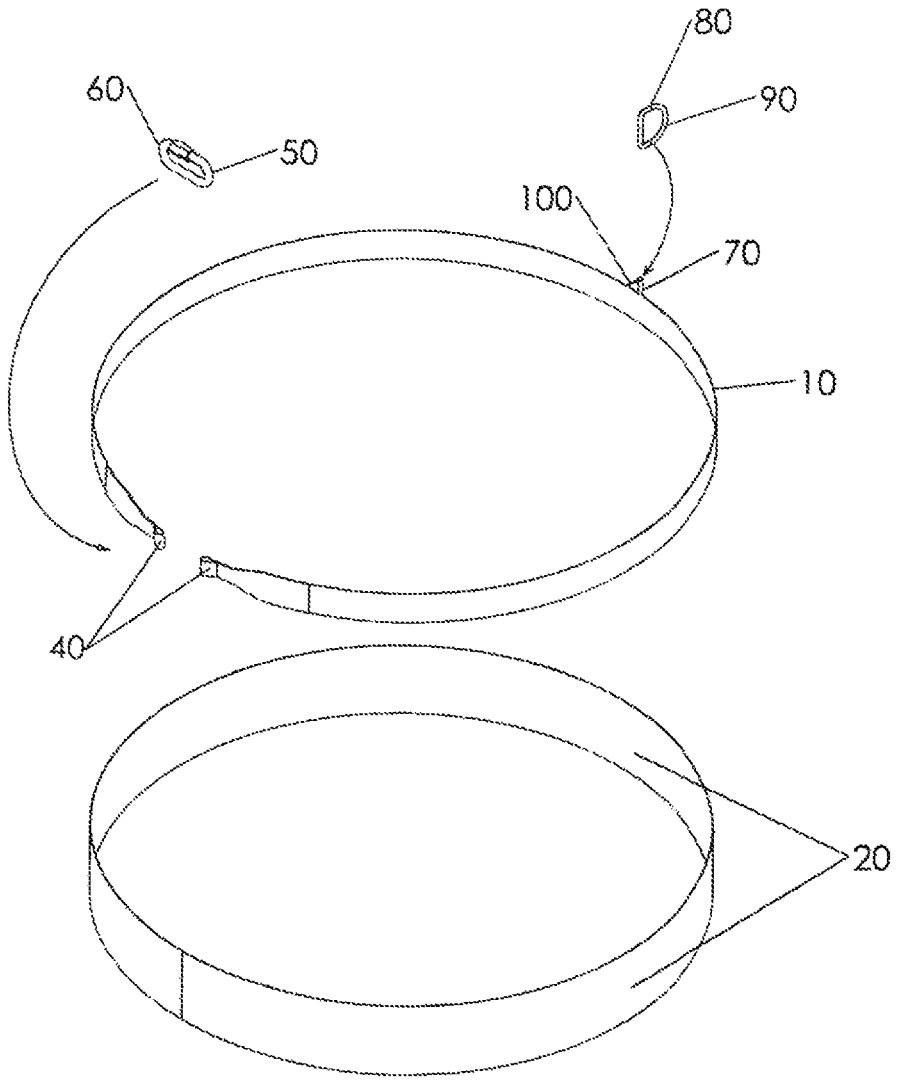
FIG. 1 is an isometric exploded view of an apparatus of the present invention.
Figure 2:
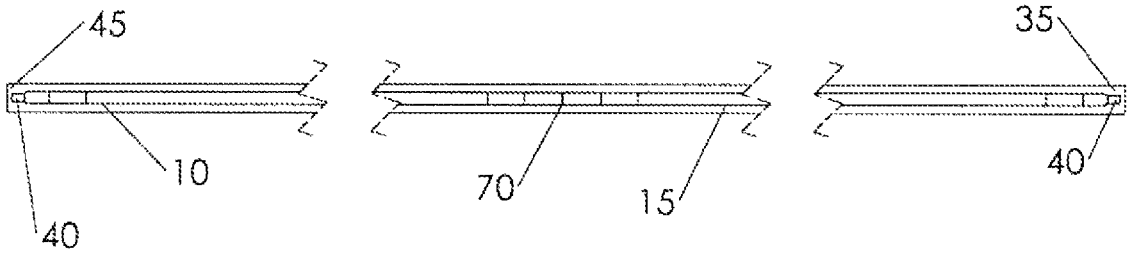
FIG. 2 is a top view of the apparatus of FIG. 1 laid flat.
Figure 3:
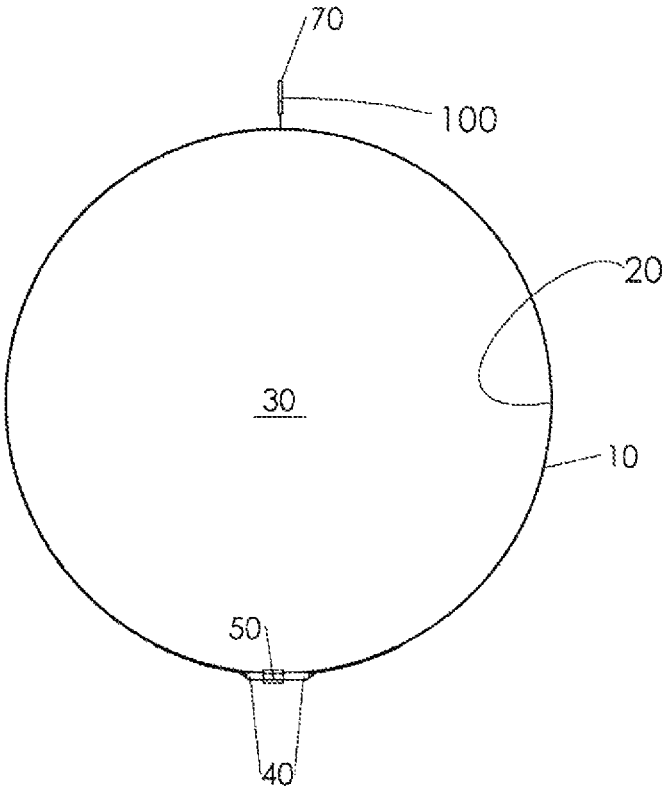
FIG. 3 a cross-section of an air beam column with the apparatus of FIG. 1.

Referring to FIGS. 1-3, a hug strap 10 is attached to a hug strap pad 20. The hug strap pad 20 is then attached to an air beam 30 (FIG. 3). The hug strap pad 20 and hug strap 10 are connected by sewing, stitching, adhesive, or other means. This allows the hug strap 10 to be securely attached to the air beam 30 without risk to the pneumatic integrity of the air beam 30.

The connection between the hug strap 10 and the hug strap pad 20 may be intermittent or spot or may be substantially continuous along the perimeter (e.g. circumference for cylindrical tube shown). The hug strap pad 20 and the air beam 30 (FIG. 3) are connected by welding, bonding, adhesive, fusing, or other means. The connection between the hug strap pad 20 and the air beam 30 (FIG. 3) may be intermittent or spot or may be substantially continuous along the perimeter (e.g. circumference for cylindrical tube shown). The hug strap 10 is generally a stronger flexible material, such as nylon. The hug strap pad 20 is generally a weaker flexible material, compatible with the air beam 30, such as vinyl or poly vinyl chloride (PVC). The hug strap pad 20 may be wider than the hug strap 10 to provide for a larger contact area with the air beam 30.

The hug strap 10 may include end loops 40, which may be connected with an end link member 50 such as a quick link or other device. The end link member 50 may provide an attachment point 60. An intermediate loop 70 may be provided, which may be connected with an intermediate link member 80, such as a d-link or other device. The intermediate link member 80 may provide an attachment point 90.

While shown as a single, substantially central or midpoint location of the hug strap 10, the intermediate loop may 70 be provided in another location, or plurality of locations. As an alternate to the end loop 40 or the intermediate loop 70, a grommet may be provided within the hug strap 10 or the standoff 100 or both.

The hug strap pad 20 and the hug strap 10 generally conform or 'hug' the perimeter surface of the air beam 30 (in the case of the air beam 30 shown having a circular cross section, the circumference). A standoff 100 may provide radial separation between the intermediate loop 70 and the hug strap 10.

While shown as extending about a perimeter (circumference) of the air beam 30, the hug strap pad 20 and hug strap 10 may alternatively extend only about a portion of the perimeter of the air beam 30.

Figure 4:
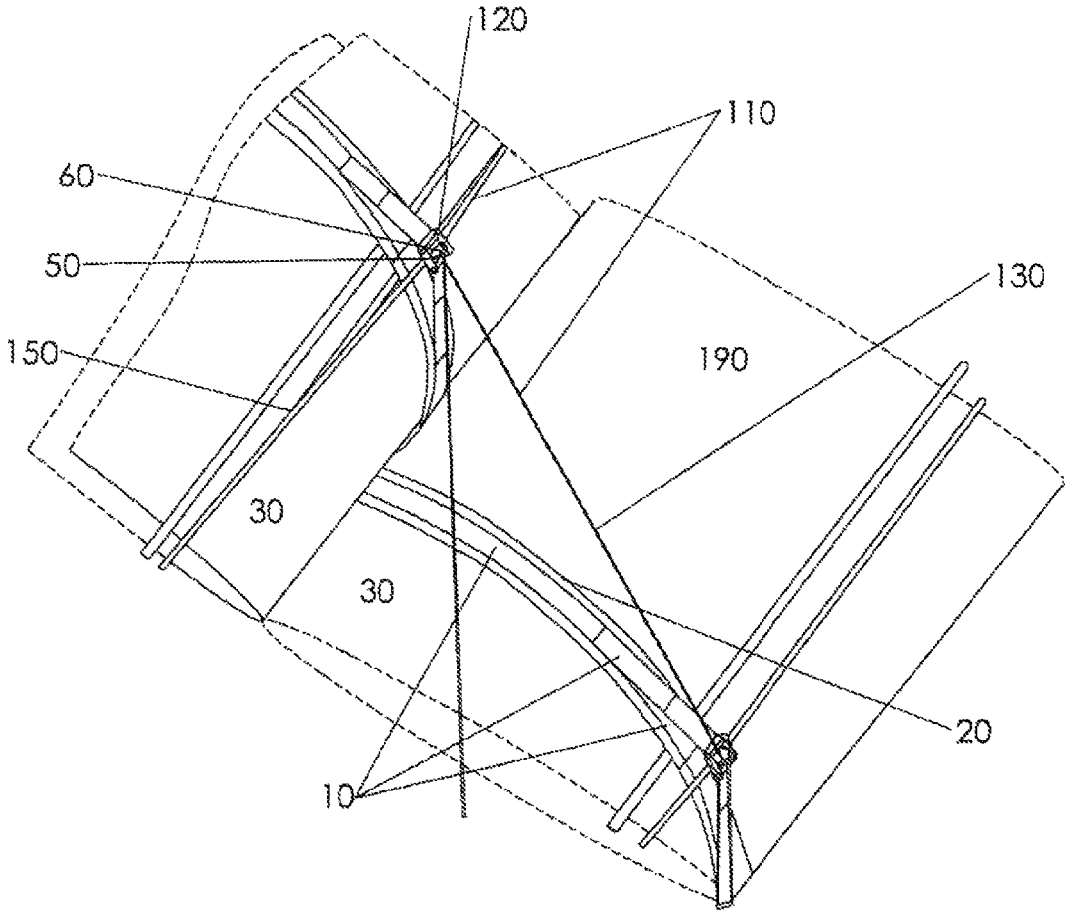
FIG. 4 is an isometric view of an apparatus of the present invention with air beam columns.
Figure 5:
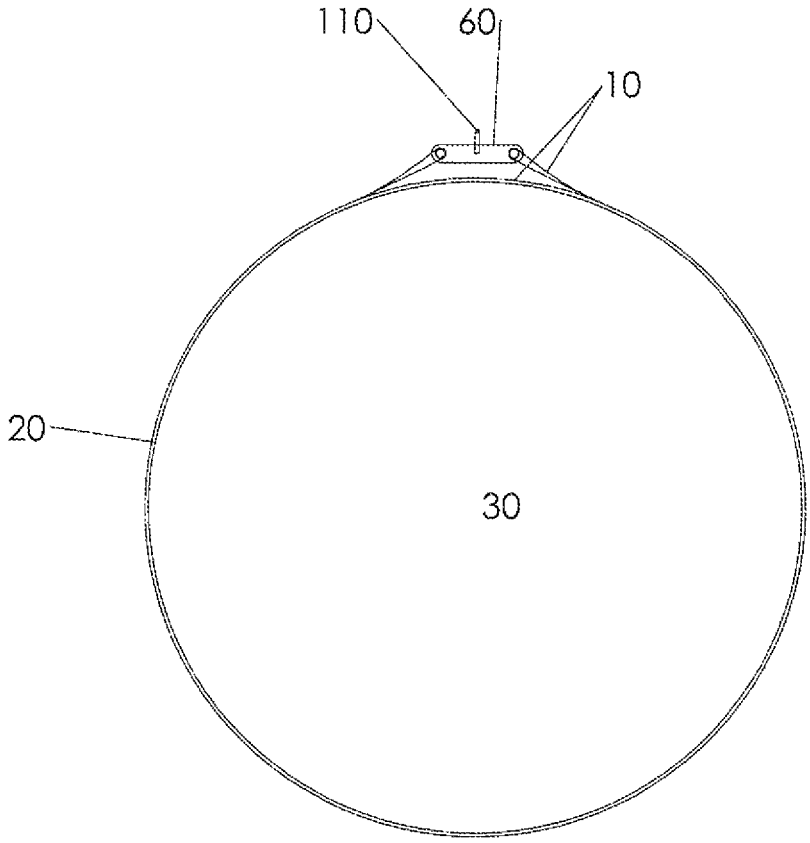
FIG. 5 is a cross-section of one of the air beam columns of FIG. 4.
Figure 6:
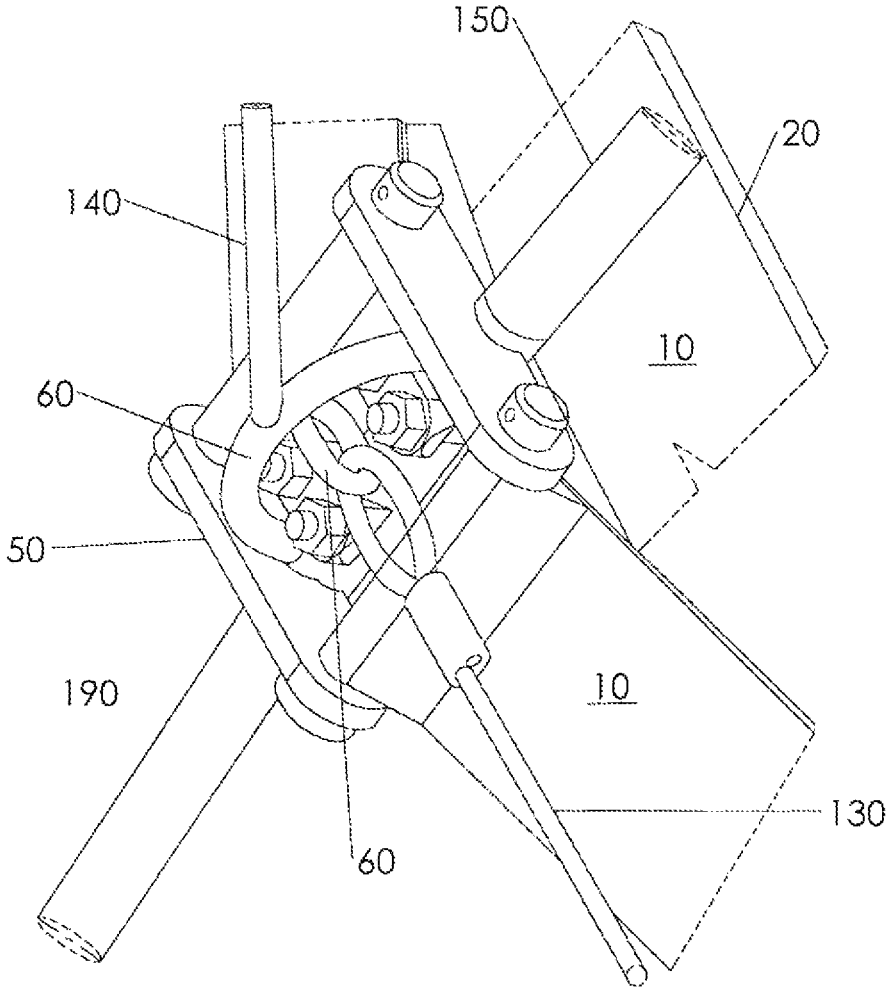
FIG. 6 is a isometric detail of one of the air beam columns of FIG. 4.

Referring to FIGS. 4-6, the apparatus of the present invention may be used to connect or attach a wide variety of attachments 110 and air beams 30, in a number of fixed or floating configurations or both. Referring to FIG. 4, a wide variety of attachments may be connected with the air beam 30 via the attachment point 60 or the attachment point 90 or both. The attachments may include a guy wire 140, a reinforcing member 150, a cable 130, or other attachment known to one skilled in the art, or a combination thereof.

Figure 7:
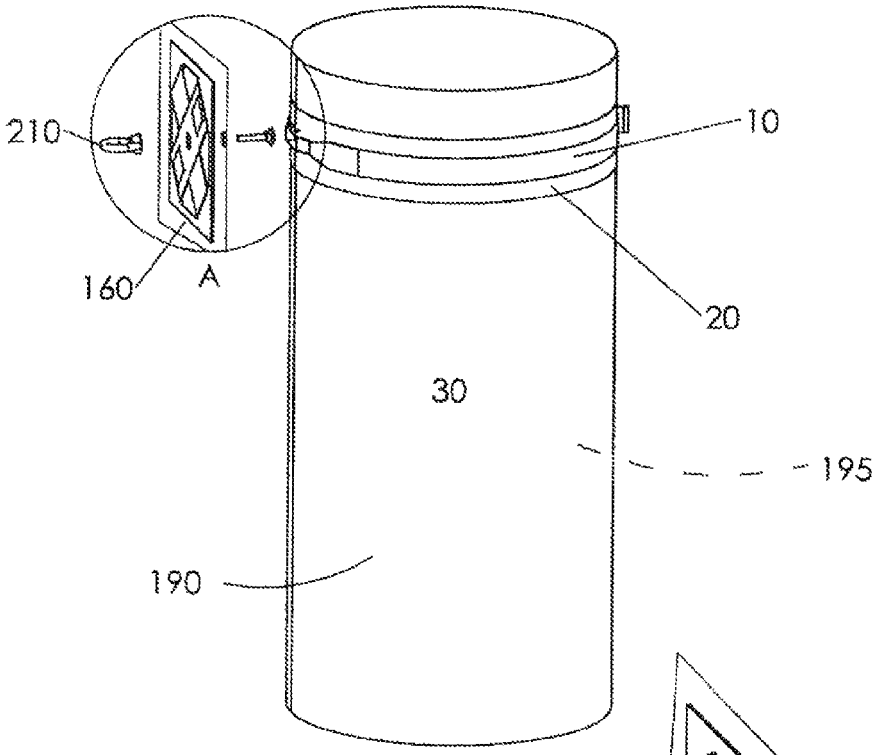
FIG. 7 is an isometric view of the apparatus of FIG. 1, shown with an attachment in the form of a fly.
Figure 8:
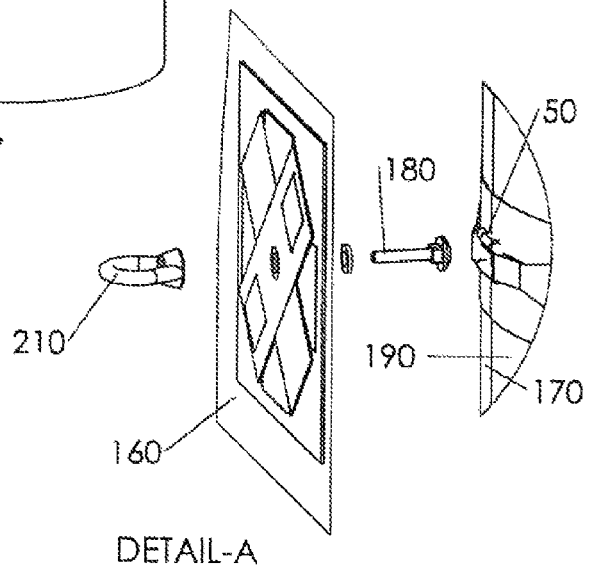
FIG. 8 is a detail view of the apparatus of FIG. 7.
Figure 9:
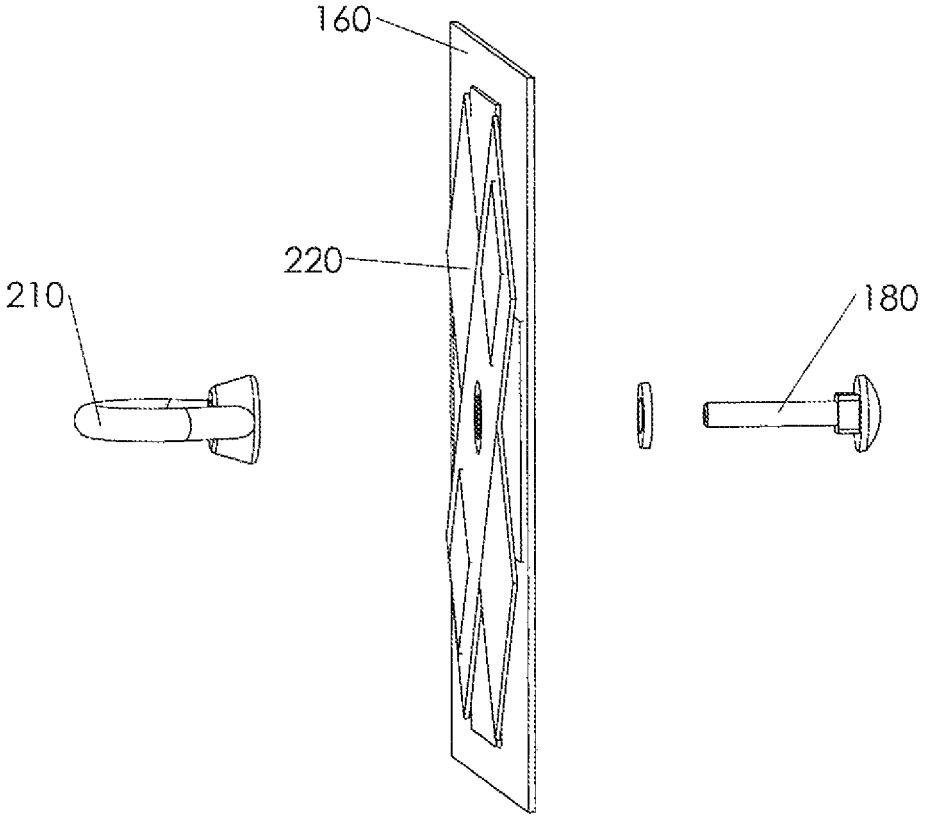
FIG. 9 is a detail view of the apparatus of FIG. 7.

Referring to FIGS. 7-9, the apparatus of the present invention may be used to connect or attach a fly 160 or other flexible (or rigid or semi rigid) covering on the outside 190 or inside 195 or both of a number of the air beams 30 (forming a structure). A fastener 180 (e.g. bolt) may extend between the hug strap 10 through the fly 160 to provide a connection (e.g. eye nut 210) to the air beam 30 through the fly 160. A reinforcement 220 may be added around the fastener 180.

Figure 10:
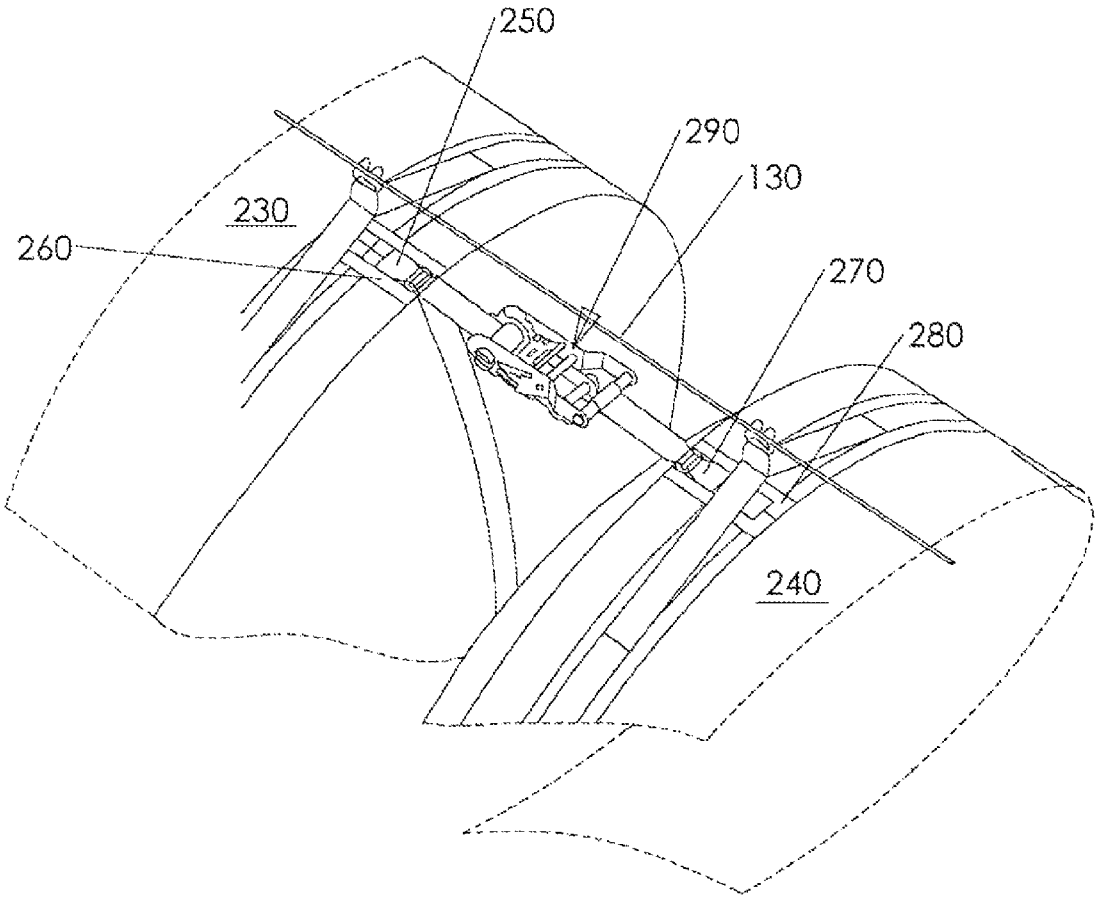
FIG. 10 is an isometric view of an apparatus of the present invention in the form of an axial/longitudinal embodiment.
Figure 11:
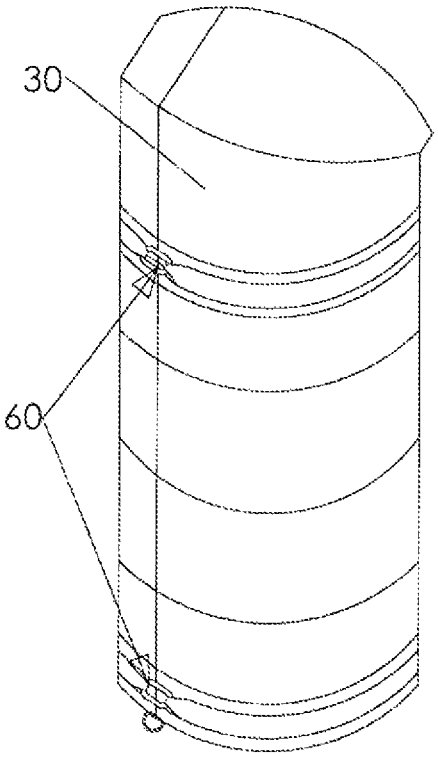
FIG. 11 is a section view of an air beam with a hug strap of the present invention.
Figure 12:
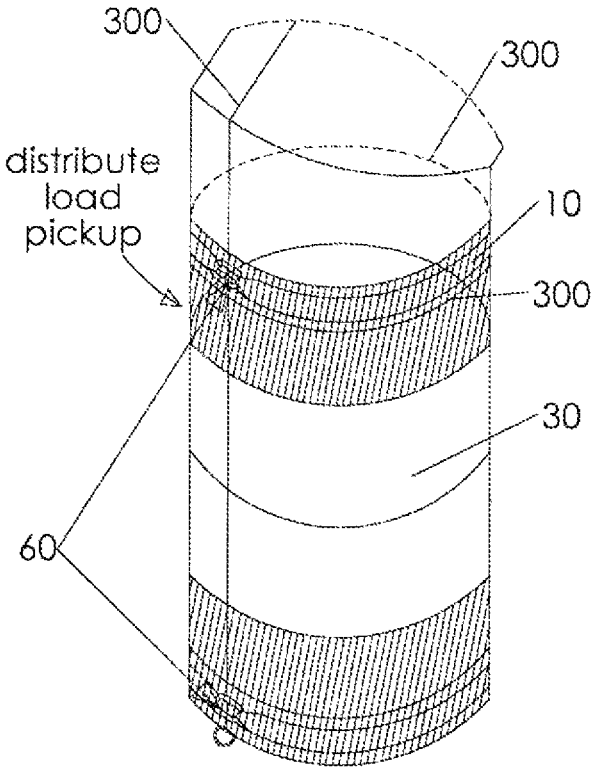
FIG. 12 is a section view of an air beam with a hug strap of the present invention.
Figure 13:
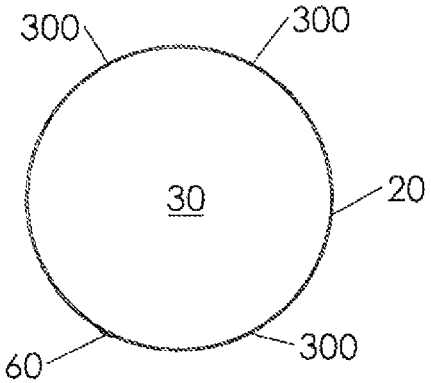
FIG. 13 is a top section of the air beam of FIG. 12.
Figure 14:
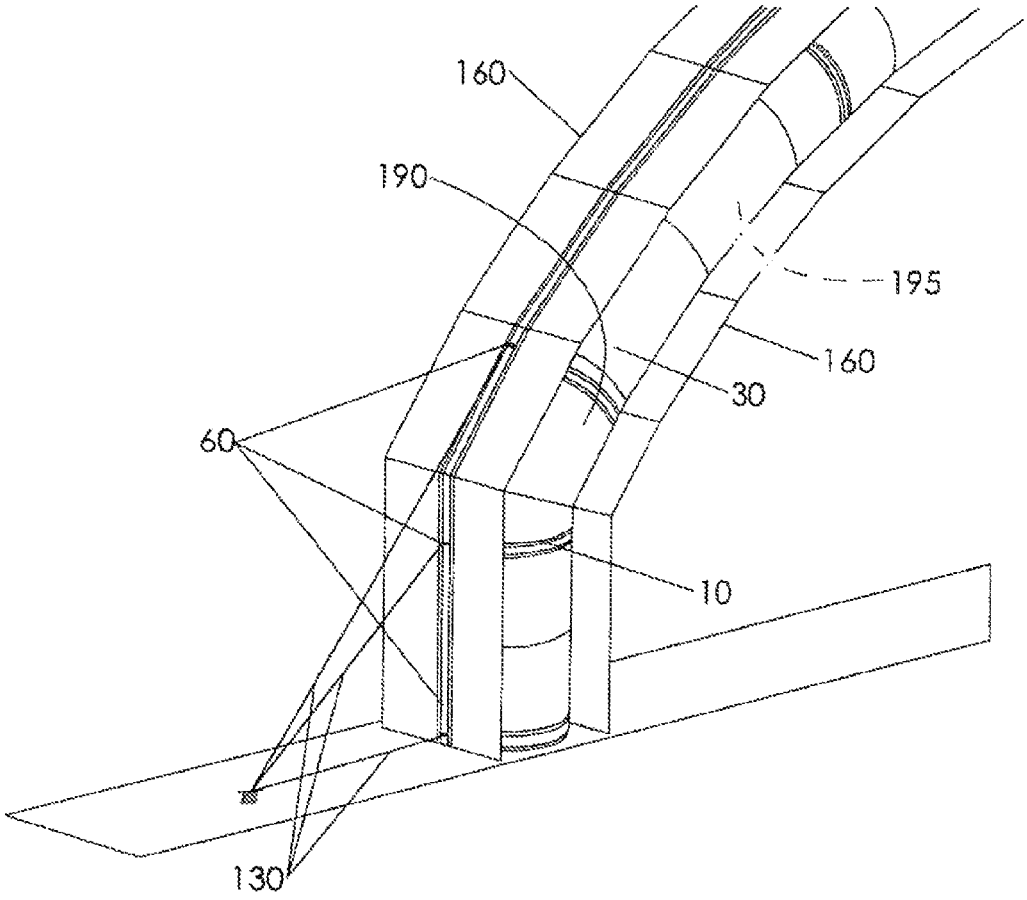
FIG. 14 is a cutaway section of an air beam structure using a hug strap of the present invention.

Referring to FIG. 10, apparatus of the present invention may be used to connect the air beams 30 (connect a first air beam 230 and a second air beam 240, for example end to end, as shown). A first hug strap 250 attaches to a first hug strap pad 260, and the first hug strap pad 260 attaches to the first air beam 230. A second hug strap 270 attaches to a second hug strap pad 280, and the second hug strap pad 280 attaches to the second air beam 240. The first hug strap 250 and the second hug strap 270 are fixed together by a cable 130 or otherwise, or may be drawn together and fixed in place, for example by a ratchet assembly 290. As shown, this axial connection may be combined with the perimeter design of FIGS. 1-9.

Referring to FIGS. 11-14, the hug strap 10 is shown in securing the air beam 30. The cables 130 extend between the attachment point 60 and an anchor to secure the structure. The hug strap 10 and the hug strap pad 20 or both may be relatively wide and may attach to the air beam 30 at a limited number of points (see FIGS. 12-13), for example by weld 300.

In the preceding description, for purposes of explanation, numerous details are set forth in order to provide a thorough understanding of the embodiments of the invention. However, it will be apparent to one skilled in the art that these specific details are not required in order to practice the invention.

The above-described embodiments of the invention are intended to be examples only. Alterations, modifications and variations can be effected to the particular embodiments by those of skill in the art without departing from the scope of the invention, which is defined solely by the claims appended hereto.

What is claimed is:

1. An apparatus for connecting an attachment and an air beam, the apparatus comprising:

a hug strap pad attached to a circumferential surface of the air beam; and an elongate hug strap having a perimeter surface attached to the hug strap pad, the elongate hug strap having a first end that extends overtop of the hug strap pad to encircle the circumferential surface of the air beam and connect with a second end of the hug strap by an end link member to create an attachment point;

wherein the hug strap is securely attached overtop of the hug strap pad and about the circumferential surface of the air beam.

2. The apparatus of claim 1, wherein the elongate hug strap is attached to the hug strap pad by stitching.

3. The apparatus of claim 1, the hug strap pad comprising an elongate strap.

4. The apparatus of claim 1, wherein the elongate hug strap is color coded to identify a design parameter.

5. The apparatus of claim 4, wherein the design parameter is selected from the group consisting of design strength, design usage, year of manufacture, and sequence of assembly.

6. The apparatus of claim 1, the first and second end of the hug strap comprising a loop or a grommet.

7. The apparatus of claim 1, the elongate hug strap further comprising an intermediate connector, between the first and second end of the hug strap, the intermediate connector adapted to receive an intermediate link member to create a further attachment point.

8. The apparatus of claim 7, the intermediate connector comprising a loop or a grommet.

9. The apparatus of claim 7, further comprising a standoff extending between the elongate hug strap and the intermediate connector.

10. The apparatus of claim 1, wherein the hug strap pad is attached to the elongate hug strap substantially continuously about the perimeter surface of the elongate hug strap.

11. The apparatus of claim 1, wherein the hug strap pad is wider than the elongate hug strap.

12. An air beam comprising:

an elongate pneumatic tubular column having a circumferential surface;

a hug strap pad attached to the circumferential surface of the tubular column; and an elongate hug strap having a perimeter surface attached to the hug strap pad, the hug strap having a first end that extends overtop of the hug strap pad to encircle the circumferential surface of the air beam and connect with a second end of the hug strap by an end link member to create an attachment point, wherein the hug strap is securely attached about the circumferential surface of the tubular column.

13. The air beam of claim 12, the hug strap attached to the hug strap pad by stitching.

14. The air beam of claim 12, the hug strap pad attached to the pneumatic tubular column by welding.

15. The air beam of claim 12, wherein the hug strap pad is attached to the elongate hug strap substantially continuously about the perimeter surface of the elongate hug strap.

16. The air beam of claim 12, wherein the hug strap pad is attached to the circumferential surface of the tubular column substantially continuously about the circumferential surface of the tubular column.

17. The air beam of claim 12, wherein the hug strap pad is wider than the elongate hug strap.

18. A method of securing an attachment to an air beam comprising:

providing a tubular air beam having a circumferential surface;

attaching an elongate hug strap to a hug strap pad;

attaching the hug strap pad, with the elongate hug strap attached, to the air beam, wherein the elongate hug strap has a first end that extends overtop of the hug strap pad to encircle the circumferential surface of the air beam and connect with a second end of the hug strap by an end link member to create an attachment point, wherein the hug strap is securely attached about the circumferential surface of the air beam; and securing an attachment to the elongate hug strap at the attachment point.

19. The method of claim 18, wherein the elongate hug strap and the hug strap pad are attached by stitching.

20. The method of claim 18, wherein the hug strap pad and the air beam are attached by welding.

21. The method of claim 18, wherein the attachment is selected from the group consisting of a guy wire, a reinforcing member, a cable, or a combination thereof.

22. An apparatus for connecting a first air beam to a second air beam, the apparatus comprising:

a first hug strap pad attached to a circumferential surface of the first air beam;

a first elongate hug strap attached to the first hug strap pad, the first elongate hug strap having a first end that extends overtop of the first hug strap pad to encircle the circumferential surface of the first air beam and connect with a second end of the first hug strap by a first end link member to create a first attachment point;

a second hug strap pad attached to a circumferential surface of the second air beam;

a second elongate hug strap attached to the second hug strap pad, the second elongate hug strap having a first end that extends overtop of the second hug strap pad to encircle the circumferential surface of the second air beam and connect with a second end of the second hug strap by an end link member to create a second attachment point; and biasing means for biasing the first elongate hug strap and the second elongate hug strap together at the first and second attachment points.

23. The apparatus of claim 22, wherein the biasing means comprises a ratchet assembly.

* * * * *